US012559854B2

(12) United States Patent
Perez Planas et al.

(10) Patent No.: US 12,559,854 B2
(45) Date of Patent: Feb. 24, 2026

(54) DEVICE FOR THE ELECTROPOLISHING OF MULTIPLE FREE- MOVING ITEMS BY MEANS OF SOLID ELECTROLYTES

(71) Applicant: STEROS GPA INNOVATIVE, S.L., Barcelona (ES)

(72) Inventors: Miguel Francisco Perez Planas, Cardedeu (ES); Marc Soto Hernandez, Campsentelles (ES); Marc Sarsanedas Gimpera, Olot (ES); Pau Romagosa Calatayud, Les Borges del Camp (ES)

(73) Assignee: STEROS GPA INNOVATIVE, S.L., Barcelona (ES)

( * ) Notice: Subject to any disclaimer, the term of this patent is extended or adjusted under 35 U.S.C. 154(b) by 503 days.

(21) Appl. No.: 17/879,077

(22) Filed: Aug. 2, 2022

(65) Prior Publication Data

US 2022/0364256 A1 Nov. 17, 2022

Related U.S. Application Data

(63) Continuation of application No. PCT/ES2021/070064, filed on Jan. 28, 2021.

(30) Foreign Application Priority Data

Feb. 4, 2020 (ES) ..... ES202030086

(51) Int. Cl.
*C25F 3/24* (2006.01)
*C25F 3/16* (2006.01)
*C25F 7/00* (2006.01)

(52) U.S. Cl.
CPC ..... *C25F 3/24* (2013.01); *C25F 3/16* (2013.01); *C25F 7/00* (2013.01)

(58) Field of Classification Search
CPC ..... C25D 17/16–26; C25D 21/10
See application file for complete search history.

(56) References Cited

U.S. PATENT DOCUMENTS 1,335,177 A * 3/1920 Merritt ..... C25D 1/02 205/228
3,087,874 A 4/1963 Greisl
(Continued)

FOREIGN PATENT DOCUMENTS

CN 109735891 A 5/2019
DE 2031833 A1 12/1971
(Continued)

OTHER PUBLICATIONS

International Search Report with English translation, PCT Application No. PCT/ES2017/070247, mailed Aug. 9, 2017, 5 pages.
(Continued)

*Primary Examiner* — Brian W Cohen
(74) *Attorney, Agent, or Firm* — Edell, Shapiro & Finnan, LLC

(57) ABSTRACT

An assembly for electropolishing metal surfaces by means of particles of solid electrolytes in a gaseous environment. According to one embodiment the assembly includes a container and a housing element configured to house at least two metal parts, so as to contain the parts avoiding that they can go out during the electropolish process and at the same time allowing that they can have a given movement within the housing element and at the same time endow them with electrical connectivity by means of a first electrode and a second electrode that are coupled to an electrical source 3. The assembly also includes means to produce a relative movement between the particles of solid electrolytes and the at least two metal parts.

20 Claims, 4 Drawing Sheets

(56) References Cited

U.S. PATENT DOCUMENTS

| | | | |
|---|---|---|---|
| 3,523,834 | A | 8/1970 | Hewins |
| 3,533,928 | A | 10/1970 | Inoue |
| 3,620,953 | A | 11/1971 | Inoue |
| 3,776,827 | A | 12/1973 | Inoue |
| 6,074,284 | A | 6/2000 | Tani et al. |
| 6,156,187 | A | 12/2000 | Akagi et al. |
| 6,739,953 | B1 | 5/2004 | Berman et al. |
| 6,957,511 | B1 | 10/2005 | Eigh et al. |
| 10,683,583 | B2 | 6/2020 | Sarsanedas Millet |
| 10,975,491 | B2 | 4/2021 | Sarsanedas Millet |
| 2003/0178320 | A1 | 9/2003 | Liu et al. |
| 2004/0019389 | A1 | 1/2004 | Swords |
| 2004/0234683 | A1* | 11/2004 | Tanaka ..... B22F 1/18 427/212 |
| 2005/0014890 | A1 | 1/2005 | Small et al. |
| 2006/0163083 | A1 | 7/2006 | Andricacos et al. |
| 2007/0017818 | A1 | 1/2007 | Emesh et al. |
| 2008/0099345 | A1 | 5/2008 | Piesslinger-Schweiger et al. |
| 2008/0188162 | A1 | 8/2008 | Koba |
| 2008/0217186 | A1 | 9/2008 | Bohme |
| 2010/0096584 | A1 | 4/2010 | Saeki |
| 2013/0000878 | A1 | 1/2013 | Janzer et al. |
| 2014/0011689 | A1 | 1/2014 | Sandip et al. |
| 2014/0018244 | A1 | 1/2014 | Taylor et al. |
| 2014/0027739 | A1 | 1/2014 | van de Weijer et al. |
| 2014/0076739 | A1 | 3/2014 | Andreacchi |
| 2017/0144239 | A1 | 5/2017 | Uo et al. |
| 2018/0029021 | A1 | 2/2018 | Boal et al. |
| 2018/0029851 | A1 | 2/2018 | Polumati et al. |
| 2018/0066375 | A1* | 3/2018 | Morgan ..... C25D 17/16 |
| 2018/0361529 | A1 | 12/2018 | Liang et al. |
| 2019/0099854 | A1 | 4/2019 | Suen et al. |
| 2020/0270763 | A1 | 8/2020 | Sarsanedas-Millet |

FOREIGN PATENT DOCUMENTS

| | | | |
|---|---|---|---|
| ES | 2604830 | A1 | 3/2017 |
| ES | 2721170 | A1 | 7/2019 |
| GB | 1513532 | | 6/1978 |
| JP | S6164900 | A | 4/1986 |
| JP | H0259216 | A | 2/1990 |
| JP | H06-88294 | A | 3/1994 |
| JP | 2002093758 | A | 3/2002 |
| JP | 2008196047 | A | 8/2008 |
| JP | 2017214615 | A | 12/2017 |
| WO | 0161080 | A1 | 8/2001 |
| WO | 2006119058 | A1 | 11/2006 |
| WO | 2007121999 | A2 | 11/2007 |
| WO | 2010084213 | A1 | 7/2010 |
| WO | 2013143115 | A1 | 10/2013 |
| WO | 2016/193736 | A1 | 12/2016 |
| WO | 2017186992 | A1 | 11/2017 |
| WO | 2018172586 | A1 | 9/2018 |
| WO | 2019/145588 | A1 | 8/2019 |

OTHER PUBLICATIONS

Extended EP Search Report, Application No. 17788863.3, Jun. 14, 2019, 16 pages.

International Search Report received in related application No. PCT/ES2019/070027, dated Apr. 4, 2019 (4 pages).

Amberlite 2582RF H, http://www.lenntech.com/Data-sheets/Rohm-&-Haas-amberlite-252-RF-H-L.pdf), year, 2000, 2 pages.

International Search Report and Written Opinion, PCT Application No. PCT/ES2019/070753, Dec. 18, 2019, 17 pages.

International Search Report and Written Opinion received in international application No. PCT/ES2019/070751, dated Dec. 16, 2019, 8 pages.

International Search Report in PCT/ES2020/070499, mailed Dec. 11, 2020, 4 pages.

* cited by examiner

FIG. 6
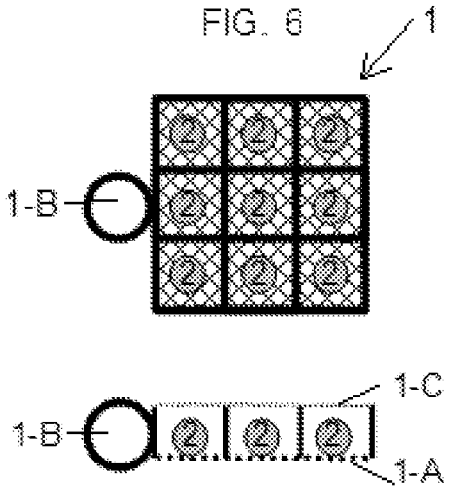
FIG. 7
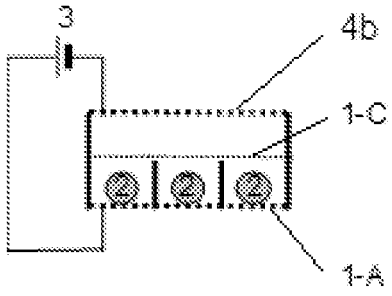
FIG. 8

DEVICE FOR THE ELECTROPOLISHING OF MULTIPLE FREE- MOVING ITEMS BY MEANS OF SOLID ELECTROLYTES

CROSS-REFERENCE TO RELATED APPLICATIONS

This application relates to and claims the benefit and priority to International Application No. PCT/ES2021/070064, filed Jan. 28, 2021, which claims the benefit and priority of Spanish Patent Application No. P202030086, filed Feb. 4, 2020, the entire contents of which are hereby incorporated by reference.

FIELD

This invention refers to a system for the dry electropolish of metals of large series without firm hold. This system that falls on the field of the industrial metal polishes results to be a system applicable in sectors that require high quality finishes for large series of parts, such as, for example, the car, aeronautics, decoration, watchmaking, medical, dental sector, among several others.

BACKGROUND

There exists the industrial need to polish large series of metal parts. Currently, the industrial metal polish of large series is carried out by means of abrasive processes or by means of electropolishing in liquid.

The systems of polish that use abrasives present a series of drawbacks. They produce a lack of homogeneity on the surface applied because the abrasion is related to the pressure between the surface and the abrasive. The most exposed parts sustain more abrasive action, which generates a loss of definition of vortexes and edges. The abrasive systems provoke inclusions of the abrasive in the metal surface, reducing the durability, the chemical resistance and the tensile strength.

In the polishes that use abrasive, the parts can be introduced together with the abrasive in drums, barrels, etc. which allow to process multiple parts in a single process without holding individually each one is required.

Also, there exists electropolishing systems with liquid. Although these systems do not produce inclusions, they show certain limitations. The electropolishing systems have a smoothing effect on the roughness of an order of magnitude of micrometers. The commercial systems of conventional electropolish often claim a reduction of the roughness ranging from 50 to 60% on the initial roughness. In many applications, this level of smoothing is not sufficient. These systems tend to disclose the metal underlying crystalline structure. This gives rise to stepped surfaces, holes and other defects related to the metal structure.

Recently, in 2016, a dry electropolish method has been developed that uses particles (free solid matters) as solid electrolytes. This invention, which is detailed in the patent ES2604830, discloses how a metal part firmly held and connected to an anode, moves within a container that contains conductor free solid matters (solid electrolyte particles) and a cathode. A description of particles used for this process is detailed in the document ES2721170 (A1). This method produces a process of metal elimination where the metal surface contacts the particles, that means, on the roughness peaks, because there is passage of current only at the contact points, generating a polish process with spectacular results without affecting vortexes nor edges. This technology has meant a revolution in the sector of polishes because it allows to treat, with excellent results, metals such as, for example, iron, steels, cobalt chromium, bronze, titanium, nickel alloys, zinc, etc.

As the process only occurs at the contact points, for a homogenous polish a relative movement of the parts with respect to the solid electrolyte particles is essential, that makes sure that the full surface is treated. A deficit of movement carries problems, such as non-homogenous results (exposed parts against internal parts), "craters" appearing at the points where there was no movement, among others. For this, this technology requires firmly holding the parts, in an individual manner, because they move in a medium of particles that do not form a fluid and that produce mechanical resistance. In practice, this is translated into the need of holders that possess clamps or elements that exert a certain force. For this, each part requires a given time for the holder mounting, checking and dismounting. Although this can be an acceptable drawback in individual parts and small series having a high added value, it limits the application of this method in case of mass industrial production.

To be able to extend this emerging technology of dry electropolish to the industrial production of large series, it is necessary to overcome the said limitations with a new system that allows to simultaneously process a great number of parts. The main challenge is to endow with electric connectivity the parts to be polished without having to firmly hold them, one by one, and that, at the same time, a sufficient relative movement occurs among the particles of solid electrolyte and the surface of the parts to be polished. According to our knowledge up today's date, there does not exist any device that meets the said technical characteristics.

This invention provides a device for polishing multiple metal parts without the drawbacks of the abrasive polish or the liquid electrochemicals, nor it has the limitations of the electropolishes with solid electrolytes.

DESCRIPTION

In order to reach the objectives and to avoid the above-mentioned limitations, this invention proposes a system for the electropolish using particles of solid electrolyte with the capacity to simultaneously process multiple parts.

The key point of the invention is the element 1 that allows to house multiple parts and endows them with electrical connectivity at same time it is capable to leave it producing a relative movement of the parts with respect to the surface of the parts to be polished.

The device for electropolishing metal surfaces by means of solid electrolytes object of the invention comprises:

- a container 6,
- an element 1 capable to house at least two metal parts, which means to contain the parts 2 avoiding that they can go out during the electropolish process and at the same time allowing that they still can have a given movement within the element 1, and endow them with electrical connectivity by means of a first electrode 4*a*,
- a second electrode 4*b*,
- an electrical source 3 connected to the first electrode 4*a* to the second electrode 4*b*,
- a medium composed of particles 5 of solid electrolyte in a gaseous environment, and
- means to produce a relative movement of the particles 5 with respect to the metal parts to be polished 2.

A basic schematic view of the invention can be seen in the FIG. 1.

The parts 2 to be polished are placed in the element 1 where they contact a first electrode 4*a* connected to the electrical source 3. The latter supplies an electrical current that flows between the parts 2 and the second electrode 4*b* through the particles of the medium 5. The system produces a relative movement of the particles with respect to the parts to be polished. The particles 5 do not contact the full surface of the part, but they are geometrically limited to contact only the roughness peaks. Only at these contact points the passage of electrical current occurs and only there, redox reactions occur that can generate oxides, salts, etc. that the particles eliminate. In this manner a selective elimination of metal occurs at the roughness peaks, producing a polish global effect.

The element 1 that houses the parts is designed in order that the parts contact an electrode of conductor material, which is connected to the electrical source 3 and in order that the particles of the medium 5 have sufficient contact, connectivity and movement with the parts to be polished 2. The element can be metal or conductor polymer. The element 1 houses the parts to be polished 2 within it, that means, it contains the parts 2 avoiding that they can go out during the polish process and at the same time allowing that they can still have a given movement within the element 1. This way, it is avoided to have to individually hold each of the parts, which is translated in a significant reduction of hand work time.

In order that it has a long service life, preferably, the electrode is of a metal resistant to the electrical or chemical corrosion, such as stainless steel, titanium platinum, irradiated titanium MMO coated titanium.

It is possible that the electrode is a mesh. In certain formations, the electrode must be a mesh having a suitable size that allows the flow of the particles, but that does not allow the parts to be polished to escape.

The element 1 can have a compartment for several parts or a compartment available for each of them. Preferably, the element 1 is compartmented to avoid contacts and marks between the parts. The walls of the compartments can be conductor extending thus the surface of the first electrode 4*a* and favoring the parts electrical connections. This configuration is suitable for parts that, due to their geometry, have electrical contacts problems with the base. Alternatively, the compartment walls can be of non-conductor polymer material, provided that a sufficient contact is assured of the parts with the base that secures a sufficient electric connectivity.

The parts to be polished 2 can be of a conductor material. They must contact the element 1 anode at least, at a point to receive the current applied. The shape and size of the parts determine an optimal movement of the parts 2 with respect to the medium of particles 5, as well as an optimal design of the element 1.

The electrical source 3 provides an electric current to the element 1 and of an opposite sign to the two electrodes 4*a*, 4*b*.

In the simpler case, the current applied is direct current, positive to the element 1 that acts as first electrode 4*a* and negative to the second electrode 4*b*.

The current applied can also be alternating power current, rectified alternating current or pulsed current. To have the control on the current applied, preferably the electrical source provides a pulsed current, the length of which can be regulated, and of a voltage or intensity of the pulse positive and negative, as well as that of the pauses between them. Preferably, the source will have an indicator of current voltage and intensity The pulses applied depend on the material to be polished, the parts geometry and size. For example, to polish parts of carbon steel, 12V direct current can be used. However, other metals require the use of micropulses. For example, to polish parts of titanium, the following pulsed current can be used: 10 microseconds at 0V; 10 microseconds at 30 V; 10 microseconds at 0V; 30 microseconds at −30V.

The second electrode 4*b* is electrically connected to the opposite electric pole of the first electrode 4*a* of the element 1 that is in contact with the parts 2. During the polish process the first electrode 4*a* is in contact with the particles of solid electrolyte 5 so that current flows between the first electrode 4*a* and the parts 2 to be polished through the medium of particles 5 of the solid electrolyte. The first electrode 4*a* can be of any conductor material. Preferably, the electrode is of electric and chemical corrosion resistant metal such as stainless steel, titanium platinum, irradiated titanium, MMO coated titanium.

The conductor medium in which the process is carried out is composed of particles of solid 5 electrolyte in a gaseous medium. These particles of solid electrolyte 5 have the capacity to conduct the electricity in a measurable manner and are capable of eliminating oxides and salts from the metal surface. Preferably, the particles of solid electrolyte are formed by resins of ionic exchange that retain liquid, either in the gel phase or in porosities. The liquid retained can be neutral, acid or basic, depending on the metal to be polished. In a preferred formation to polish steels, the liquid is a solution at 5% of methane sulfonic acid. In a referred formation to polish chromium-cobalt alloy, the liquid is a solution at 4% of sulfuric acid. The particles can have different shapes: spherical, lenticular, irregular, gravel-type, rods, fibrillar, etc. Preferably, the particles have a shape somewhat spherical, which facilitates the movement and rolling on the surface. Preferably, the average diameter of the particles is less than 900 micrometers, To increase the mobility of the particles 5 medium, it is appropriate to use a fluidification medium. Preferably, vibration is used to cause movement of the medium. The vibration can be applied at one or several points such as, for example, in the container 6 that contains the particles to improve the general movement of the medium or, in the element 1 for controlling the time of contact of the particles with the parts. The use of vibration does not exclude the use of other fluidification methods.

In order that the polish process is successful, a relative movement of the parts to be polished 2 must exist with respect to the particles 5. This movement must be designed bearing in mind the geometry of the parts and of their position in the element 1. This movement can be achieved by means of different systems.

In the embodiment of the invention, the relative movement of the particles 5 with respect to the parts 2 can be obtained with an "hourglass-like" system schematized in the FIG. 2. At the intermediate part of the container 6 the element 1 is located that contains the parts 2 and is connected to the electrical source 3 through the first electrode 4*a*. The second electrode 4*b* can be at the intermediate part initially above 4*a* and the parts, or alternatively, anchored on the container 6. The particles 5 are initially at the bottom of the container. There is a motorized system that allows to turn the container 6. When it is turned, a fall of the particles occur through the elements that are located at the center that are at least the element 1 and the first electrode 4*a*. While the fall of the particles lasts, the electric contact occurs that closes the circuit between the parts connected to 4*a* and the second electrode 4*b*, which produces the electropolish effect. If the second electrode 4*b* is initially above the parts, when the container 6 turn occurs, the second electrode 4*b* will be below and the first electrode 4*a* above. In this case, the system can have a control to change the polarity of the electrodes (4*a*, 4*b*).

Optionally, the device comprises a third electrode 4*c* located within the container on the side opposite to the second electrode 4*b*. The system can have a control to alternatingly activate the electrodes 4*b* and 4*c* at each turn, to secure the alternating passage of current between the first electrode 4*a* and electrodes 4*b* and 4*c*. The objective is to have an electrode (4*b* or 4*c*) that can contact the particles 5 before these later reach the parts 2 in the element 1. That means, the system possesses two electrodes (4*b*, 4*c*) one at the upper side and the other at the lower side of the element 1 and means for activating and deactivating the electrodes (4*b*, 4*c*) at each turn, so that only the electrode that is located at that moment on the upper side is electrified, so that it is secured that there can be an electric contact between the parts 2, electrified by the electrode 4*a*, passing thorough the medium in movement of particles 5 up to the electrode (4*b* or 4*c*), active at that moment.

In an "hourglass-type" embodiment the fall of the particles may be controlled so that the passage of the particles 5 through 1 occurs when the final vertical position has been reached.

To control the fall of the particles 5, several strategies can be used. As it can be seen in the FIG. 2, preferably the fall of the particles 5 is controlled by means of at least two perforated plates (7,8) located each of them between the second electrode 4*b* or the third electrode 4*c* and the end of the container 6 closest to the said electrode. The holes of the perforated plates 7 and 8 are preferably circular with a diameter ranging from 2 to 5 times the average diameter of the spheric particles. That means, for particles having an average diameter of 0.7 mm, the perforated plate with circular holes of 2.5 mm would be optimal. The control of the fall of the particles 5 through the perforated plates (7,8) is preferably achieved by applying vibration to the perforated plates 7 and 8. After that the container 6 turn occurs, the particles are located between one of the ends of the container and above one of the perforated plates 7 or 8. As the particles 5 are of a granular material, they barely fall through the holes because of the formation of arcs, bridges, etc. that avoid that the particles 5 continue falling through the holes. When the vibration of the perforated plate (7,8) is activated in contact with the particles, the bridges, arcs, etc. lose stability and the particles 5 start flowing in a continuous manner. This allows to carry out the full turn process without a great number of particles falling until the final vertical position is obtained and the vibration of the perforated plate (7 or 8) has been activated that prevents the uncontrolled fall of the particles 5. In this manner, a more homogenous treatment is obtained on all the parts.

In another embodiment of the invention, the relative movement of the particles 5 with respect to the parts 2 can be achieved with a "waterwheel-type" system, schematized in the FIG. 3. In this system, one or several elements 1 are connected to a central axis around which they can turn when the system is operating. Part of the circular path around the axis of the elements 1 runs within the medium of particles 5. The elements 1 are connected to an electrical source 3. The electrode (4) can be moving together with the elements 1 or, alternatively, be anchored to the container 6 housing the particles 5.

In another embodiment of the invention, the relative movement of particles with respect to the parts is achieved with a particles "recirculating" system, as it can be seen in the FIG. 4. The particles 5 are recirculated from the bottom of the container 6 up to the upper part. This produces a continuous flow of the particles 5. In this flow, one or more elements 1 are located connected to the source 3 that contain the parts to be polished 2. The second electrode 4*b* is located close to the element 1. The device can include a vibrator to improve the movement (the fluidity) of the particles.

In another embodiment of the invention, the relative movement of particles with respect to the parts is achieved by means of a "pistons" system. In FIG. 5, it is shown how the particles 5 move by means of a piston in a vertical direction. It is also possible to produce this movement in horizontal direction or to use several pistons to produce the movement of the particles. The element 1 with the parts and connected to the source 3 is located in this movement of particles. The system can be composed of several pistons that are not operating together but that carry out complementary movements.

This system can improve the results on the parts if the electric impulse is coordinated with the period of compression. Synchronizing the electric impulse with the period of compression increases the conductivity and secures a homogenous action on the parts.

In another embodiment of the invention, the medium of particles 5 can be in vibration but without translational movement, the element 1 being the one that travels through the medium of particles. In a container 6 there are particles 5 provided with vibration in which an element 1 moves that retains the parts to be polished 2 connected to an electrode 4*a*. The movement of the element 1 allows that the particles contact in movement the surface of the parts to be polished. The second electrode 4*b* can be in movement together with the element 1 or anchored on the container 6.

In another embodiment of the invention, to generate a movement of the particles 5, a toroid vibrator or circular vibrator is used. These types of vibrators produce a circular flow of the particles of solid electrolyte 5. In this flow, are located one or several duly oriented elements 1 with the parts 2, one or several electrodes 4*a*,4*b*, with the related connections to the source 3.

In another embodiment of the invention, to generate movement, there is a "paint stirrer-type" system. In this system, the movement of the particles 5 is achieved by means of a quick macroscopic back and forth translation, with rotations in different axis or with a combination. This system produces the said movement to a container 6 that contains the particles 5, elements 1 with the parts 2 and electrodes 4*a* and 4*b*. The elements 1 and electrodes 4*a*, 4*b* are rigidized with respect to the walls of the container 6.

Preferably, the element 1 consists of a receptacle with a conductor base (1-A) on which the parts 2 are placed, that is connected to the source 3 and preferably, possesses vibration (1-B). This base (1-A) is a metal mesh or a perforated plate, which allows the passage of the particles 5 through it and at the same time retains the parts to be polished 2.

To avoid that the parts have an excess of movement, that movement can be restrained by means of the use of different strategies. It is possible to compartmentalize the surface of the mesh to achieve that a part or several parts fit in each compartment that do not interfere to each other, this avoids possible defects by contact between the parts. The parts can be generally covered with an elastic or rigid non-conductor mesh (1-C) in order that the parts keep a position and orientation suitable for the process as it has been illustrated in the FIGS. 6 and 7. The second electrode 4*b* can form part of the same structure of the element 1 as it is shown in the FIG. 8, this way the gap between the electrodes is minimized and a higher conductivity is achieved. It has to be made sure that the second electrode 4*b* is closer to the parts than to the conductor part (1-A) in order that the polish effects occur on the parts.

A device base on this invention allows the polish process of multiple parts avoiding the need to individually hold each of them. This opens the door to using the dry electropolish process at industrial scale, meaning a significant improvement on the current state-of-the art. With this device, not only polish can be produced but also the metal surfaces passivation and anodization.

With all the mentioned in this description, we deem that it is possible to understand the operation of this device, to reproduce the invention as well as to understand the multiple advantages of this novelty system.

BRIEF DESCRIPTION OF THE DRAWINGS

To complement the description being carried out and in order to assist to best understanding the characteristics of the invention, attached to this specification, as an integral part thereof, there is a set of drawings in which, for illustration and no limitation purpose, the following has been represented:

FIG. 6.—It shows a top view of a formation of the element 1

FIG. 7.—It shows a lateral view of the formation of the element 1 of the FIG. 6.

FIG. 8.—It shows a top view of another formation of the element 1.

PREFERRED EMBODIMENT OF THE INVENTION

Below, a preferred embodiment is described to polish engraved stainless-steel discs of a 40 mm diameter by 0.5 mm height.

Figure 1:
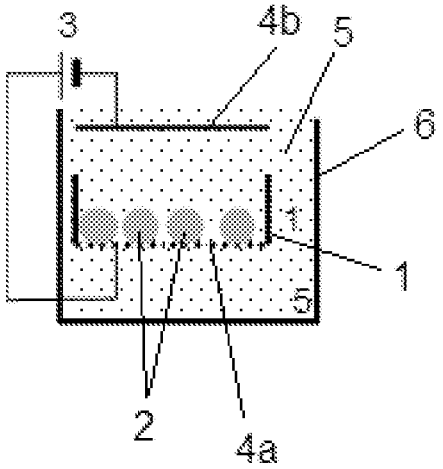
FIG. 1.—It shows a schematic basic view of the invention.
Figure 2:
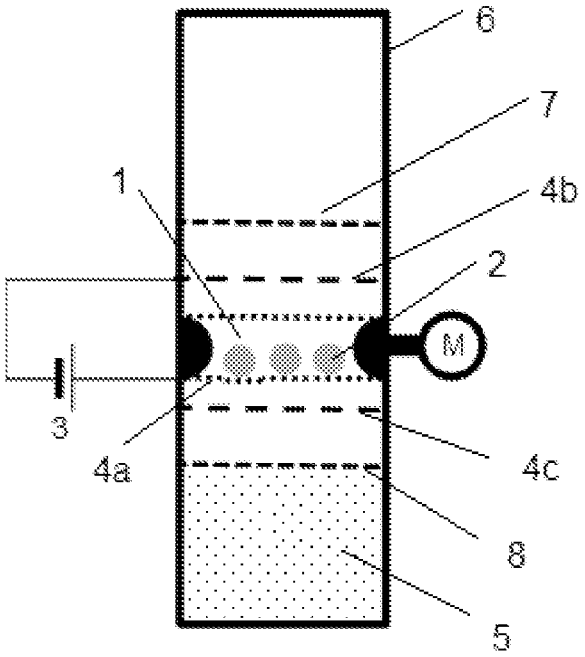
FIG. 2.—It shows a schematic view of the "hourglass-like" formation.
Figure 3:
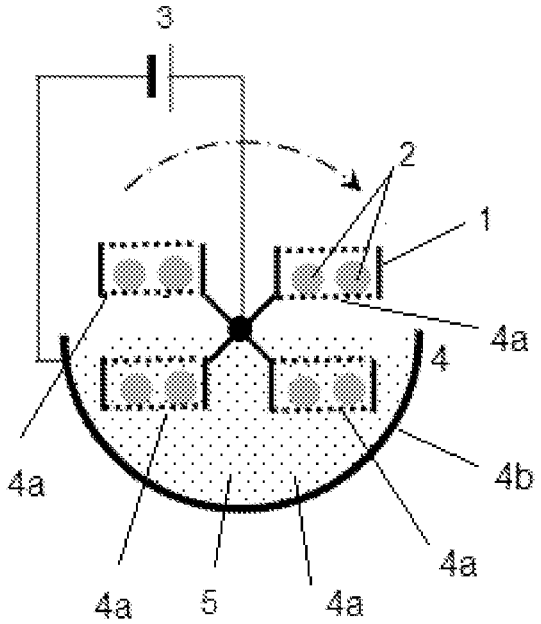
FIG. 3.—It shows a schematic view of the "waterwheel-like" formation.
Figure 4:
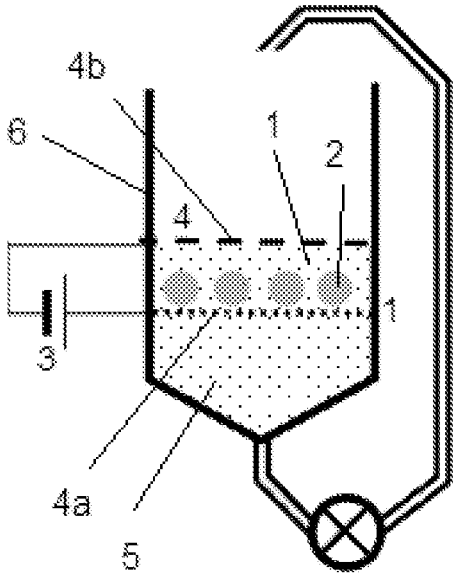
FIG. 4.—It shows a schematic view of the "recirculation-like" formation.
Figure 5:
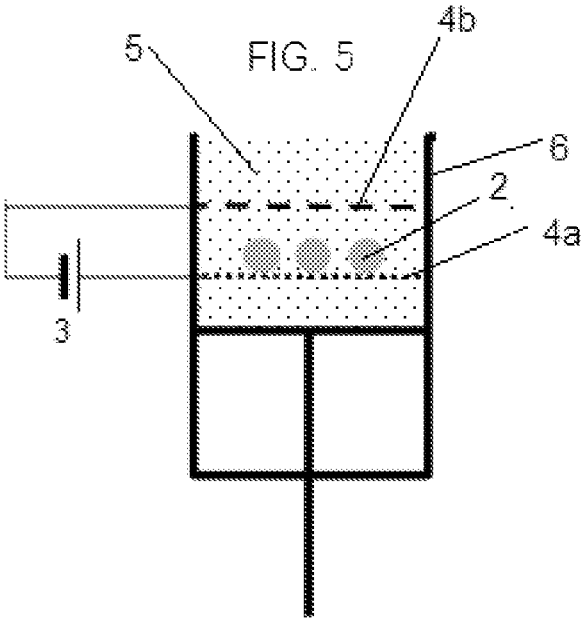
FIG. 5.—It shows a schematic view of the "pistons-like" formation.

The device is of the "waterwheel-type" schematized in the FIG. 3. It possesses four elements 1. Each element 1 consists of 128 compartments (8×16), square-shaped, designed to house one disc each. Each compartment has a 45 mm side and a 2 mm height, a base of Titanium MMO mesh in which the wires are spaced 5 mm. The mesh base is connected to the electrical source. Covering all the compartments there is a removable net with a 10 mm gap that avoids that the discs to be polished go out from the compartment during the process. Above the net, at 10 mm of the mesh base, there is another mesh of Titanium MMO, that serves as electrode (4), therefore it is connected to the complementary pole of the electric source.

Each element 1 is equipped with a vibrator. Each element 1 is joined to the rotation axis, and in turn it possesses an own rotation center. The final movement of the element 1 with respect to the rotation center can be of circular translation, orbital, free, fixed, etc. The rotation axis that joins to the four elements 1 is adjustable as for the height.

The electric source 3 is a pulse source that allows to control the voltage and length of the positive and negative pulses and the pauses between them. To polish the stainless-steel discs, optimal parameters are +15 V 300 ms; 0 V 10 ms; 15 V 30 ms; 0 V 10 ms.

The particles of solid electrolyte 5 are spheric particles of gel of poly(styrene-covinylbenzene) with a distribution of sizes centered in 750 μm with a sulfonation corresponding to 1.7 eq/L. The liquid fraction of the gel is a solution of methane sulfonic acid at 5%. The particles of electrolyte are contained in a polypropylene tank, it includes outlets to be able to inject gases and liquids. It possesses four vibrators to fluidify the whole of the particles.

What is claimed is:

1. An assembly for electropolishing metal surfaces, the assembly comprising:

a container holding a plurality of particles of solid electrolytes formed by resins of ionic exchange that retain a neutral, acid or basic liquid;

an electrical source;

a housing element located inside the container and configured to house at least two metal parts such that the at least two metal parts have a freedom of movement inside the housing element, the housing element configured to prevent a falling out of the at least two metal parts during an electropolishing of the at least two metal parts, the housing element including a first electrode for connecting the at least two metal parts to a first pole of the electrical source;

a second electrode located inside the container and connected to a second pole of the electrical source, the first and second poles having opposite polarities, and the second electrode electrically coupling the second pole to the electrical source to the plurality of particles of solid electrolytes; and means to produce within the container a relative movement between the plurality of particles of solid electrolytes and the at least two metal parts to polish the metal surface of the at least two metal parts within the container.

2. The assembly according to claim 1, wherein the plurality of particles of solid electrolytes partially fill the container.

3. The assembly according to claim 1, wherein the housing element includes at least first and second compartments for respectively holding the at least first and second metal parts.

4. The assembly according to claim 3, wherein each of the at least first and second compartments includes walls that are electrically conductive.

5. The assembly according to claim 3, wherein each of the at least first and second compartments includes walls that are electrically nonconductive.

6. The assembly according to claim 1, wherein the housing element includes a base configured to support the at least first and second parts, the base comprising a plurality of through holes that are sized to permit a passage of the plurality of particles of solid electrolytes therethrough.

7. The assembly according to claim 6, wherein the base is a mesh.

8. The assembly according to claim 1, further comprising a vibrator element coupled to the housing and configured to provoke a vibration of the at least first and second metal parts inside the housing element when the vibrator element is energized.

9. The assembly according to claim 6, wherein the plurality of particles of solid electrolytes partially fill the container and the container is rotatable by an actuator, the housing element and the second electrode being configured to move integrally with the container such that when the container rotates the plurality of particles of solid electrolytes pass through the plurality of holes in the base of the housing element.

10. The assembly according to claim 9, further comprising a third electrode located inside the container, the second electrode and the third electrode being configured to be alternatively connected to the second pole of the electrical source depending on an orientation of the container to alternatively electrically couple the second pole of the electrical source to the plurality of particles of solid electrolytes, the second electrode being located on a first side of the housing element, the third electrode being located on a second side of the housing element, the second side being opposite the first side, the actuator being configured to cause the container to assume a first orientation in which the second electrode is located above the third electrode and a second orientation in which the third electrode is located above the second electrode, the movement of the container between the first and second orientations causing a movement of the plurality of particles of solid electrolytes across the at least first and second metal parts and the second and third electrodes.

11. The assembly according to claim 10, further comprising first and second plates that each comprise a plurality of through holes, the first plate being located on the first side of the housing element, the second electrode being located nearer the housing element than the first plate, the second plate being located on the second side of the housing element, the third electrode being located nearer the housing element than the second plate.

12. The assembly according to claim 1, wherein the means to produce a relative movement between the plurality of particles of solid electrolytes and the at least two metal parts causes a rotating movement of the housing element within the plurality of particles of solid electrolytes.

13. The assembly according to claim 12, wherein the first electrode moves together with the housing element.

14. The assembly according to claim 1, wherein the housing element and the second electrode are submerged in the plurality of particles of solid electrolytes, and the means to produce a relative movement between the plurality of particles of solid electrolytes and the at least two metal parts includes a recirculation system that takes the plurality of particles of solid electrolytes disposed at a bottom of the container and delivers them into a top part of the container at a location above the housing element.

15. The assembly according to claim 14, further comprising a vibrator device coupled to the container that when energized is configured to provoke an improvement in the recirculation of the plurality of particles of solid electrolytes.

16. The assembly according to claim 1, wherein the element and the second electrode are submerged in the plurality of particles of solid electrolytes, the means to produce a relative movement between the plurality of particles of solid electrolytes and the at least two metal parts comprising a piston that moves inside the container alternating towards and away from the housing element to cause a movement of the plurality of particles of solid electrolytes in relation to the housing element.

17. The assembly according to claim 16, wherein when the piston moves towards the housing element, the electrical source applies an electric current to the first electrode and to the second electrode, and when the piston moves away from the housing element, the electrical source does not apply an electric current to the first electrode and to the second electrode.

18. The assembly according to claim 1, wherein the housing element and the second electrode are submerged in the plurality of particles of solid electrolytes and the means to produce a relative movement between the plurality of particles of solid electrolytes and the at least two metal parts includes an actuator that is configured to move the housing element within the plurality of particles of solid electrolytes.

19. The assembly according to claim 1, wherein the housing element and the second electrode are submerged in the plurality of particles of solid electrolytes and the means to produce a relative movement between the plurality of particles of solid electrolytes and the at least two metal parts includes a toroid vibrator or a circular vibrator that provokes a circular movement of the plurality of particles of solid electrolytes within the container.

20. The assembly according to claim 1, wherein the housing element and the second electrode are located submerged in the plurality of particles of solid electrolytes and are each fixed inside the container, the means to produce a relative movement between the plurality of particles of solid electrolytes and the at least two metal parts including one or more actuators that act on the container to cause both a translational movement and a rotational movements of the container.

* * * * *